United States Patent [19]

Matsuo et al.

[11] 4,310,120

[45] Jan. 12, 1982

[54] ELASTIC RAIL FASTENING DEVICE

[75] Inventors: Yoshio Matsuo; Kentaro Matsubara, both of Tokyo, Japan

[73] Assignee: Tetsudo Kizai Kogyo Company Limited, Tokyo, Japan

[21] Appl. No.: 125,390

[22] Filed: Feb. 27, 1980

[30] Foreign Application Priority Data

Apr. 27, 1979 [JP] Japan ..... 54-055904[U]

[51] Int. Cl.[3] ..... E01B 9/34

[52] U.S. Cl. ..... 238/349; 238/310; 238/351

[58] Field of Search ..... 238/349, 217, 282, 283, 238/321, 351, 310, 315, 353

[56] References Cited

U.S. PATENT DOCUMENTS

| | | | |
|---|---|---|---|
| 3,451,621 | 6/1969 | De Splinter | 238/315 |
| 3,658,247 | 4/1972 | Serafin et al. | 238/349 |
| 3,870,231 | 3/1975 | Toyama et al. | 238/324 |
| 3,894,687 | 7/1975 | Jacobson | 238/310 |
| 3,904,114 | 9/1975 | Kasvba | 238/349 |
| 3,970,248 | 7/1976 | Molyneux | 238/349 |
| 4,109,860 | 8/1978 | Serafin et al. | 238/349 |
| 4,179,067 | 12/1979 | Baier | 238/349 |

*Primary Examiner*—Richard A. Bertsch

*Attorney, Agent, or Firm*—Blanchard, Flynn, Thiel, Boutell & Tanis

[57] ABSTRACT

An elastic rail fastening device which uses a metal spike having a projecting jaw, the lower part of the spike being buried in a concrete support. A deformed S-shaped plate spring is provided with one end contacting the upper surface of a spring receiver, a first bent-down portion urged downwardly for depressing the upper surface of the rail flange as laid on the concrete support, a middle portion having the upper surface contacting the projecting jaw, a second bent-down portion for contacting the side of the spring receiver, and the other end contacting the side of the rail flange. The spring receiver is interposed between a guide on the concrete support and the second bent-down portion, whereby the spring receiver pushes up the one end of the spring.

12 Claims, 5 Drawing Figures

ELASTIC RAIL FASTENING DEVICE

FIELD OF THE INVENTION

This invention relates to an improved elastic device for fastening a rail, such as a railroad rail, an industrial crane rail or the like, to a support such as a concrete tie or the like, which device eliminates the use of bolts and nuts.

BACKGROUND OF THE INVENTION

In fastening a rail to a concrete tie or the like according to a conventional method, the rail is placed on the tie, with an insulating pad laid between the rail base and the tie. Both edges of the rail base are held by plate springs that are fastened from above to the tie with bolts and nuts. Fastening devices of this type have presented problems, however, since the bolts and nuts can be easily excessively tightened, or alternately, the bolts and nuts can loosen as a result of the repeated passage of railroad cars or other wheeled vehicles over the rails. Consequently this conventional type fastening device has required substantial inspection and maintenance.

To overcome the above problems, other rail fastening devices have been devised which eliminate the use of bolts and nuts, and in place thereof position the spikes preset in the concrete tie so that the transverse or sideward forces imposed on the rail are imposed directly on the spikes. These fastening devices additionally employ a spring which coacts between the spike and the top surface of the rail flange for imposing a downwardly directed hold-down force on the rail. With fastening devices of this type, however, when the sideward or transverse pressure becomes excessive, it can cause breakage of the concrete tie due to the pressure being transmitted directly from the rail through the steel spikes onto the tie.

To eliminate the aforementioned problem in this latter type of fastening device, copending application Ser. No. 53 985, which is owned by the assignee of this application, discloses an improved elastic fastening device for a rail wherein the fastening device utilizes a pair of springs for securely positioning and holding the rail, one of the springs imposing a downwardly directed hold-down force on the top surface of the rail flange, and the other spring being positioned sidewardly between the side of the rail flange and a spring receiver for absorbing the transverse forces imposed on the rail. While the improved fastening device disclosed in this copending application has proven effective in absorbing the various forces imposed on the rail, nevertheless further developments have been made with respect to the fastening device so as to further improve upon said device.

Accordingly, the present invention relates to an improved elastic fastening device for a rail, which device permits elimination of bolts and nuts and at the same time permits utilization of a single spring which is capable of engaging both the upper and side surfaces of the rail flange, which spring thus imposes the desired hold-down force on the rail and at the same time absorbs the transverse or sidewardly directed load forces imposed on the rail. The improved fastening device of this invention thus provides for a secure fastening of the rail in a manner which can be carried out rapidly and efficiently so as to require minimal maintenance, and at the same time the improved fastening device accomplishes this objective with increased structural simplicity, including minimization of components. The fastening device of this invention is particularly desirable since it facilitates and speeds up the fastening of a rail onto its support.

An embodiment of the invention will be described by reference to the accompanying drawings, as explained below.

DETAILED DESCRIPTION

Figure 1:
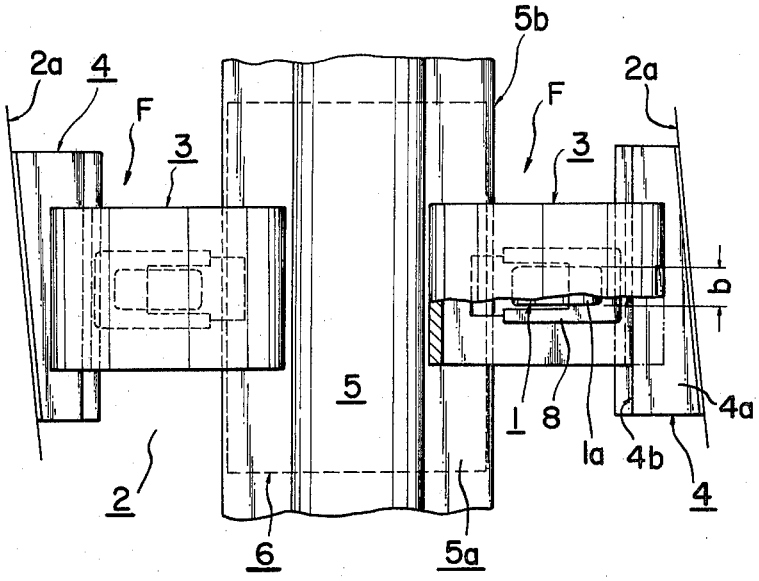
FIG. 1 is a partially broken plan view illustrating the securing of a rail by a pair of identical fastening devices constructed according to a preferred embodiment of this invention.
Figure 2:
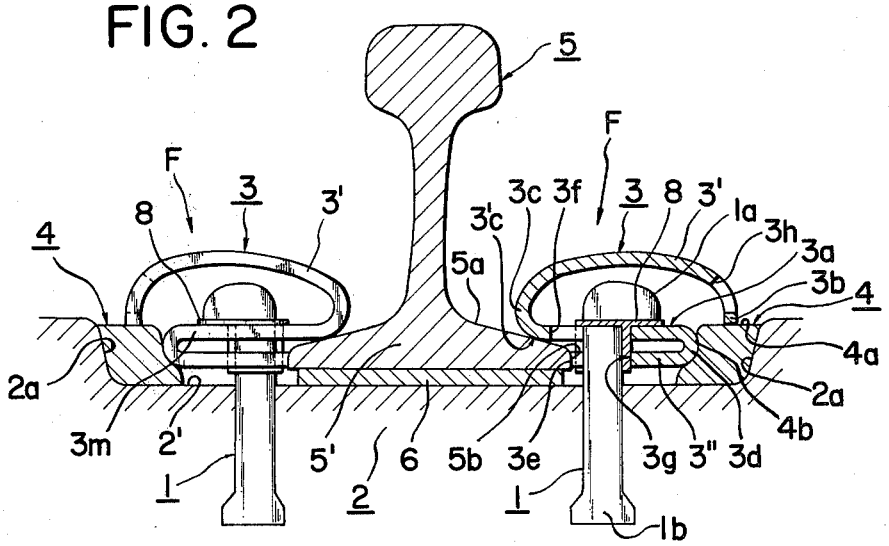
FIG. 2 is a side elevational view, partially in cross section, of the system illustrated in FIG. 1.

As indicated in FIGS. 1 and 2, a conventional elongated rail 5 is positioned with the base flange 5' thereof supported, such as through an intermediate pad 6, on a concrete support such as a floor or tie 2. The support 2 has a pair of metal (i.e., steel) spikes 1 embedded therein and positioned on opposite sides of the rail so that the spikes are spaced sidewardly from the adjacent edges of the rail base flange 5'. The rail 5 is secured relative to the support 2 by a pair of elastic fastening devices F positioned for engaging the opposite edges of the rail base flange 5'.

Each fastening device F includes a spring gripping member 3 which is engaged with the spike 1 and with the rail base flange 5', the spring member 3 also being in bearing engagement with a spring receiver 4. This receiver 4 is suitably seated against a guide or shoulder **2*a* formed on the concrete support 2, which shoulder is formed as the result of the concrete support having a suitable recess 2' formed in the upper surface thereof so as to accommodate the receivers 4 and the other components as illustrated. The opposed shoulders 2*a* extend parallel with one another, but are slightly inclined relative to the longitudinal direction of the rail, as shown in FIG. 1. It will be recognized that the bottom of this recess 2' may in reality constitute the normal upper surface of the support 2, in which case the support would be provided with upwardly extending projections thereon so as to define the shoulders 2*a***.

The steel spike 1, as illustrated, has an upper portion which projects upwardly from the concrete support 2 and, at its upper end, defines a sidewardly projecting chin or enlargement **1*a*. This enlargement 1*a* projects outwardly in a direction away from the rail 5, and defines thereunder a downwardly-directed abutment surface. The lower portion of spike 1 is embedded within the concrete support, and for this purpose is provided with an enlargement 1*b* at its lower end to prevent the spike from being pulled out of the concrete support. The spike 1** has, throughout substantially its entire length, a substantially rectangular cross section.

The spring receiver 4 normally comprises a longitudinally elongated wedge-shaped element which is slidably movable along the recess 2' in a direction approximately parallel with the rail 5. The spring receiver 4 sits against the bottom wall of the recess 2' and is urged against the shoulder 2*a*. The inner surface of the spring receiver 4 is provided with a concave curved surface 4*b* which matches a similar curved surface formed on the spring 3, as explained hereinafter.

Figure 4:
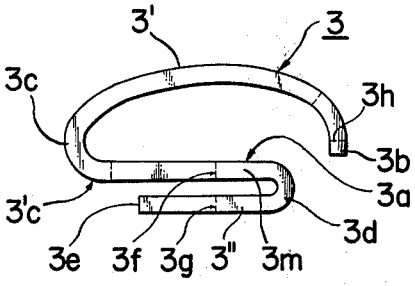
FIG. 4 is an elevational view of the S-shaped plate spring.

Considering now the spring member 3, same comprises a deformed S-shaped plate spring which is suitably bent from a single flat plate. The S-shaped spring 3 includes, as shown in FIGS. 2 and 4, a top leg portion 3′, a bottom leg portion 3″, and a middle or intermediate portion 3*m*. The top leg portion 3′, at one side of the spring, terminates in a free end portion 3*b* which is adapted for engaging the upper surface 4*a* of the spring receiver 4, as illustrated in FIG. 2. An opening 3*h* extends through the top leg portion 3′ in the vicinity of the free end 3*b* thereof.

The other end of the top leg portion 3′ is joined to the adjacent end of the middle portion 3*m* by means of a first bent portion 3*c*, which portion defines a curved noselike part and is bent through approximately one-half revolution. This bent portion 3*c* defines an outer lower surface 3′*c* thereon which is adapted for engagement with the upper surface 5*a* of the rail base flange 5′.

The middle portion 3*m* of spring 3 has a substantially flat upper surface 3*a* which is adapted to abut against the lower or bottom surface of the projecting jaw 1*a*. An insulating member 8 is normally stuck to the spring so as to lie between the spring and the spike 1. This middle spring portion 3*m* also has a rectangular opening 3*f* formed through the middle thereof, which opening is sized so as to permit the spike 1, including the jaw 1*a* thereof, to be inserted through the opening.

The other (that is, the outer) end of the intermediate spring portion 3*m* is joined to the adjacent end of the lower spring portion 3″ by means of a further bent portion 3*d*, which portion is again formed as a curved nose bent through approximately one-half revolution. This lower bent portion 3*d* defines an outer curved convex surface which is adapted to bear against the curved concave surface 4*b* formed on the inside of the spring receiver 4, as illustrated by FIG. 2.

Figure 3:
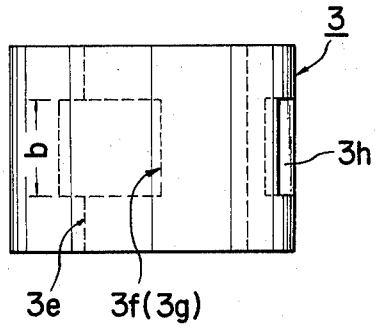
FIG. 3 is a plan view of the S-shaped plate spring.

The other end of the bottom spring leg 3″, namely that end opposite the bent portion 3*d*, terminates in a free end so as to define an end surface 3*e* which is adapted to contact and bear against the exterior side surface 5*b* of the rail flange 5′. This free end surface 3*e* is, as shown in FIGS. 2 and 4, spaced outwardly from the bent portion 3*c* and, in fact, is spaced outwardly from the innermost edge of the opening 3*f*. This lower spring leg 3″ also has a notch or opening 3*g* which extends therethrough, which notch projects inwardly from the end surface 3*e* and is aligned with the opening 3*f*. The notch 3*g* and opening 3*f* are each provided with a width b, as shown in FIG. 3, which is slightly larger than the width b′ of the steel spike 1, and have a length slightly greater than that of the spike so as to permit the spike, including the head portion 1*a*, to be inserted therethrough.

OPERATION

The following describes how the rail 5 is fastened to the concrete floor 2 using the fastening device F of this invention.

Figure 5:
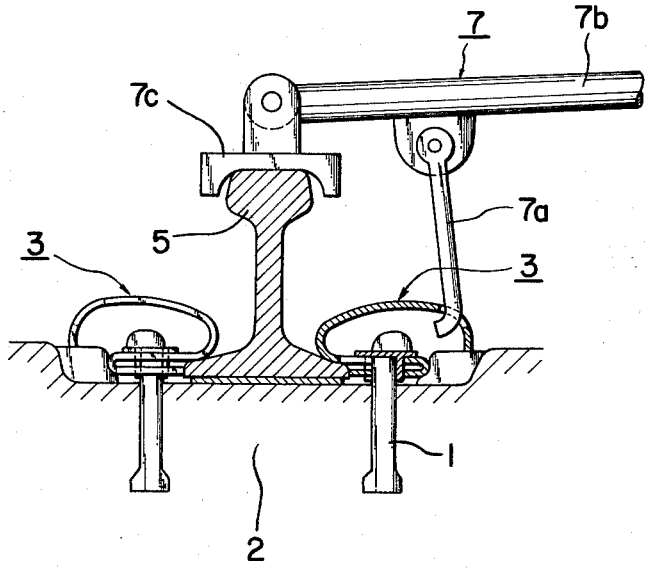
FIG. 5 schematically illustrates the fitting operation of the fastening device according to the present invention.

To begin with, the rail 5 is placed at the center of the concrete floor 2, with the pad 6 therebetween. The head 1*a* of the spike 1 is passed through the notch 3*g* and rectangular opening 3*f* of the plate spring 3. The plate spring 3 is held below the projecting head 1*a* of the steel spike 1, and pulled close to the rail 5. The insulating material 8 is stuck to the spring 3 so as to lie between the spring 3 and steel spike 1. Next, as shown in FIG. 5, the rail grip 7*c* of the fitting tool 7 is placed on the top of the rail 5. The free end of the hook 7*a* is engaged with the opening 3*h* in the plate spring 3, and the lever 7*b* is turned counterclockwise in the drawing to lift the free end 3*b* of the spring 3. With the fitting tool 7 kept in this state, the spring receiver 4 is slid, with the tapered end thereof foremost, along the spring receiver guide 2*a* into a position between said guide 2*a* and the second bent-down portion 3*d* of the spring 3. By hitting the tail end of the spring receiver 4 with a hammer, etc., the rail 5 is placed in proper position. Then, the fitting tool 7 is returned clockwise to release the spring and is removed from the rail 5 and disengaged from the spring 3. The rail fastening operation is completed by repeating the same cycle on the other side of the rail 5.

With the rail fully assembled as explained above, and as illustrated by FIG. 2, the free end 3*b* of the spring 3 bears against the upper surface of the spring receiver 4, and at the same time the upper surface 3*a* of the middle portion 3*m* is pushed against the under surface of the spike jaw 1*a*. The spring 3 is thus maintained in a resiliently deformed condition, with the lower surface 3′*c* being pushed against the upper surface 5*a* of the rail flange, thereby securely pushing the rail downwardly against the concrete tie. At the same time, the outer surface of the lower bent portion 3*d* is securely seated against the concave inner surface 4*b* formed on the spring receiver 4, which thus pushes and holds the spring inwardly against the rail, such that the lower free edge 3*e* of the spring thus snugly bears against the side edge surface 5*b* of the rail flange, whereby the spring also absorbs the side thrust imposed on the rail.

This invention is not limited to the above-described embodiment. For example, the portion between the second bent-down portion 3*d* and second end 3*e* of the plate spring 3 may be curved up or down to a greater extent than on the above-described embodiment so as to permit more flexible supporting of the lateral pressure acting on the rail 5.

Designed as described above, the rail fastening device according to this invention produces the following results:

(1) This device elastically receives the side or lateral pressure working on the rail 5 between the second bent-down portion 3*d* and the second end 3*e* of the spring 3. Since the notch or opening 3*g* in this lower leg portion 3″ is oversized relative to the spike, this prevents the side working pressure from being imposed on the spike so as to prevent breaking the concrete floor or tie, as experienced with conventional fastening devices, thus assuring a firm, safe, enduring rail fastening.

(2) This device can fasten the rail 5 to the concrete floor 2 by simply hammering the wedge-shaped spring receiver 4, with the tapered end thereof foremost, while uplifting the first end 3*b* of the plate spring 3 with the fitting tool 7. Therefore, this operation can be accomplished easily and rapidly.

(3) The plate spring 3 of this device both depresses the flange of the rail 5 and elastically receives the lateral pressure acting on the rail 5. This rationality contributes to simple design and reasonable cost of this fastening device.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An elastic rail fastening device comprising a metal spike, the upper part of the spike forming a projecting jaw and the lower part being buried in a concrete support, a deformed one-piece S-shaped plate spring, one end of the plate spring contacting the upper surface of a spring receiver, a first bent-down portion being urged downward, the lower surface of said first bent portion depressing the upper surface of the flange of a rail laid on said concrete support, a middle portion having the upper surface contacting said projecting jaw, a second bent-down portion following said middle portion contacting the side of said spring receiver, and the other end of the plate spring contacting the side of said rail flange, and said spring receiver being interposed between a spring receiver guide on said concrete support and said second bent-down portion, said spring receiver pushing up said one end of the spring.

2. An elastic rail fastening device according to claim 1, wherein said S-shaped spring includes an upper leg portion which extends between said one end and said first bent portion, said upper leg portion passing over the upper end of said metal spike, said middle portion extending between said first and second bent portions, said middle portion having an opening therein through which passes said spike, said spike having said jaw integral therewith and projecting sidewardly therefrom adjacent the upper end thereof, which said jaw is disposed above said middle portion and contacts the upper surface thereof, and said spring having a lower leg portion which extends between said second bent portion and said other end, said lower leg portion having an opening therein through which passes said spike.

3. An elastic rail fastening device according to claim 2, wherein said other end of said spring terminates at a location which is disposed between the outermost extremities of the spring as defined by said one end and said first bent portion.

4. An elastic rail fastening device according to claim 2 or claim 3, wherein said middle portion and said lower leg portion are each substantially planar and extend in substantially parallel relationship to one another, and wherein the openings in said middle portion and said lower leg portion are substantially vertically aligned and are positioned centrally thereof so as to be spaced inwardly from the opposite side edges of the spring.

5. An elastic rail fastening device according to claim 4, wherein the opening in said lower leg portion is oversized relative to said spike to prevent side forces as transferred from the rail through said lower leg portion from being imposed on said spike.

6. An elastic rail fastening device for securing an elongated rail to a concrete base, the elongated rail being positionable on top of the base and having bottom flanges projecting outwardly from opposite sides thereof, the concrete base having metal spikes embedded therein and projecting upwardly therefrom on opposite sides of said rail, each said spike defining a downwardly-directed shoulder, and said spikes being spaced outwardly from the side edges of said base flanges, said fastening device comprising:

a spring receiver removably fitted to said concrete base in sidewardly spaced relationship from said bottom flange, said spring receiver having an outer side surface which bears against a shoulder on said base, said spring receiver also having an upwardly-facing top surface and an inner side surface which faces but is spaced from the side edge of said bottom flange;

a curved platelike pressing spring coacting between said spring receiver, said spike and said bottom flange for resiliently engaging both the upper surface of said bottom flange and the side edge thereof;

said pressing spring having an S-shaped configuration which includes upper and lower leg portions with an intermediate leg portion being disposed therebetween, said upper leg portion terminating in a first free edge portion at one end thereof, which free edge portion bears against the upper surface of said spring receiver;

said S-shaped spring including a first bent portion which integrally joins the other end of said top leg portion to the adjacent end of said intermediate leg portion, said first bent portion overlapping said bottom flange and having an outer downwardly-directed surface thereon which is urged into gripping engagement with the upper surface of said bottom flange;

the intermediate portion of said spring having an upper surface thereon maintained in bearing engagement with the downwardly-directed shoulder formed on said spike;

said S-shaped spring including a second bent portion which extends between the other end of said intermediate leg portion and the adjacent end of said lower leg portion, said second bent portion being seated on the inner side surface of said spring receiver, and the other end of said lower leg portion defining a second free end portion of said spring, said second free end portion being disposed in abutting engagement with the side edge of said bottom flange.

7. An elastic rail fastening device according to claim 6, wherein said upper leg portion has an opening therein adjacent said first free edge portion for permitting a tool to be inserted therein for resiliently expanding said spring during installation thereof.

8. An elastic rail fastening device according to claim 6, wherein said lower and intermediate leg portions have aligned openings therein through which passes said metal spike.

9. An elastic rail fastening device according to claim 8, wherein said upper leg portion of said spring passes over the upper end of said spike.

10. An elastic rail fastening device according to claims 6 or 8 or 9, wherein said intermediate and lower leg portions are substantially planar and extend in substantially parallel relationship to one another, and wherein said upper leg portion terminates in said first free end portion with the latter being curved downwardly so as to abut against the upper surface of the spring receiver, whereby the latter pushes the upper leg portion upwardly to resiliently deform and stress the spring.

11. An elastic rail fastening device according to claim 6 or claim 9, wherein the opening in said lower leg portion is oversized relative to said spike to prevent side forces as transferred from the rail through said lower leg portion from being imposed on said spike.

12. In an elastic rail fastening device for securing an elongated rail to a support base, the elongated rail being positionable on top of the support base and having bottom flanges projecting outwardly from opposite sides thereof, the base having rigid spikes fixed thereto and projecting upwardly therefrom on opposite sides of said rail, each said spike having a head portion fixedly and integrally associated therewith and defining thereon a downwardly-directed support surface, said spikes being spaced outwardly from the side edges of said bottom flanges, and the base having a spring receiver thereon in sidewardly spaced relationship from said bottom flange so that said spike is positioned therebetween, said spring receiver having an upwardly-facing abutment surface and an inner side surface which is disposed opposite but spaced outwardly from the side edge of the bottom flange, the improvement comprising:

a curved one-piece S-shaped platelike spring coacting between said spring receiver, said spike and said bottom flange for resiliently engaging the upper surface of said bottom flange to press said flange downwardly and for transferring side force from the rail to the spring receiver;

said S-shaped spring including upper, intermediate and lower leg portions with a first bent portion joined between one end of the intermediate leg portion and the top leg portion, and a second bent portion joined between the other end of said intermediate leg portion and said lower leg portion;

said first bent portion being urged downwardly so that an outer lower surface thereof is engaged with the upper surface of the bottom flange for urging the latter downwardly, and the second bent portion being disposed in contact with the inner side surface of said spring receiver;

said intermediate leg portion having a portion of the upper surface thereof maintained in engagement with the downwardly-directed support surface defined on said spike;

one end of said S-shaped spring as defined on said upper leg portion being in engagement with the abutment surface on said spring receiver, whereby said spring receiver urges said upper leg portion upwardly; and the other end of said S-shaped spring as defined on said lower leg portion being disposed in engagement with the side edge of said bottom flange.

* * * * *

UNITED STATES PATENT AND TRADEMARK OFFICE

CERTIFICATE OF CORRECTION

PATENT NO. : 4 310 120

DATED : January 12, 1982

INVENTOR(S) : Yoshio Matsuo and Kentaro Matsubara

It is certified that error appears in the above—identified patent and that said Letters Patent is hereby corrected as shown below:

Column 6, lines 60-61; change "claim 6 or claim 9" to ---claim 8 or claim 9---.

Signed and Sealed this

*Twenty-third* Day of *March 1982*

[SEAL]

*Attest:*

GERALD J. MOSSINGHOFF

*Attesting Officer*

*Commissioner of Patents and Trademarks*